United States Patent [19]

Turunen et al.

[11] 3,981,121

[45] Sept. 21, 1976

[54] MACHINE FOR FILLING A SACK WITH PIECE GOODS AND CLOSING MOUTH OPENING OF THE SACK

[75] Inventors: Lasse Juhani Turunen; Heikki Rimpinen; Tauno Orsma; Aimo Peurala, all of Mantta, Finland

[73] Assignee: G. A. Serlachius Oy, Manatta, Finland

[22] Filed: July 28, 1975

[21] Appl. No.: 599,772

Related U.S. Application Data

[63] Continuation-in-part of Ser. No. 466,885, May 3, 1974, abandoned.

[30] Foreign Application Priority Data

May 7, 1973 Germany ..... 2322841

[52] U.S. Cl. ..... 53/159; 53/187; 53/258; 53/373; 53/379

[51] Int. Cl.[2] ..... B65B 35/50; B65B 7/08; B65B 51/14

[58] Field of Search ..... 53/187, 258, 384, 159, 53/373, 379

[56] References Cited

UNITED STATES PATENTS

| | | | |
|---|---|---|---|
| 2,850,855 | 9/1958 | Offutt | 53/384 X |
| 3,270,484 | 9/1966 | Sorensen | 53/258 X |
| 3,284,987 | 11/1956 | Sigmon | 53/373 |
| 3,810,344 | 5/1974 | Evans et al. | 53/258 X |

*Primary Examiner*—Travis S. McGehee
*Attorney, Agent, or Firm*—Haseltine, Lake & Waters

[57] ABSTRACT

A machine for filling a sack and closing the mouth opening of the sack. The machine comprises a sorting apparatus for stacking goods in a desired shape and a closing apparatus for folding and seaming of the mouth end of the sack. The sorting apparatus and closing apparatus are arranged after each other on the same operation line. A revolving apparatus provided with filling racks for supporting the sack is provided to be displaced in a plane perpendicular to said operation line between a first position in which said filling rack is positioned outside said line in order to receive an empty sack and a second position in which the filling rack is positioned on said line in order to be filled with goods and pushed to said closing apparatus for closing the mouth opening of the filled sack.

4 Claims, 20 Drawing Figures

FIG. 9
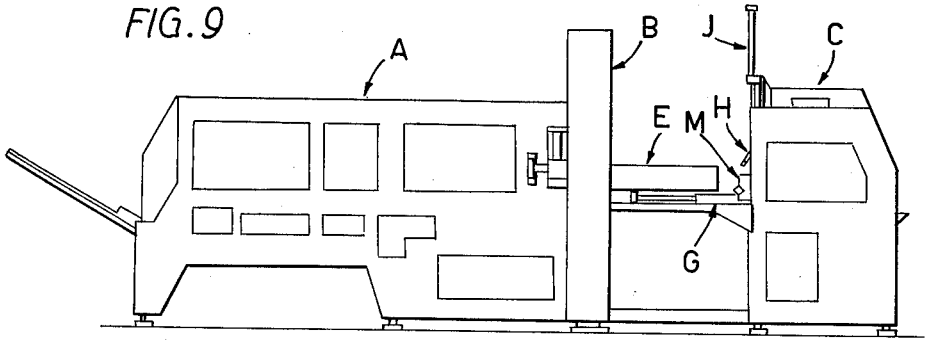
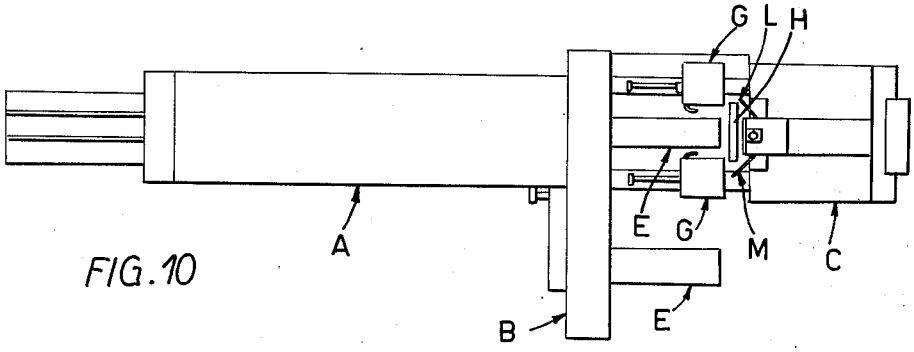
FIG. 10
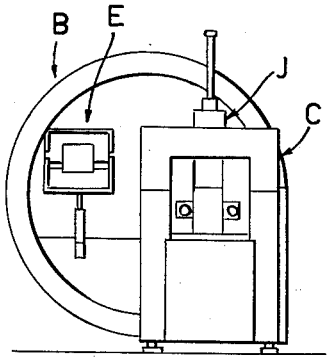
FIG. 11

FIG. 14
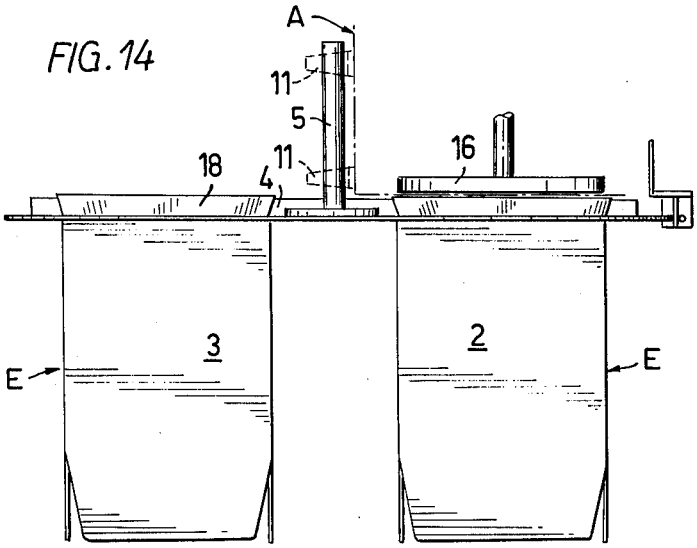
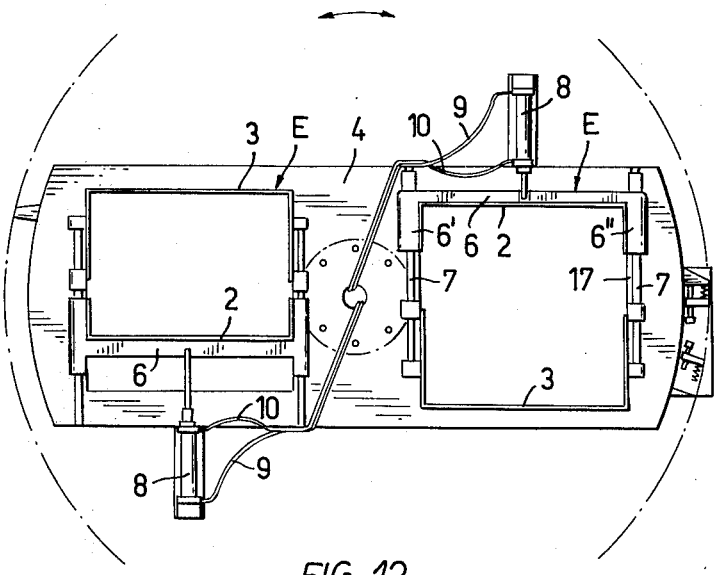
FIG. 12

FIG. 16
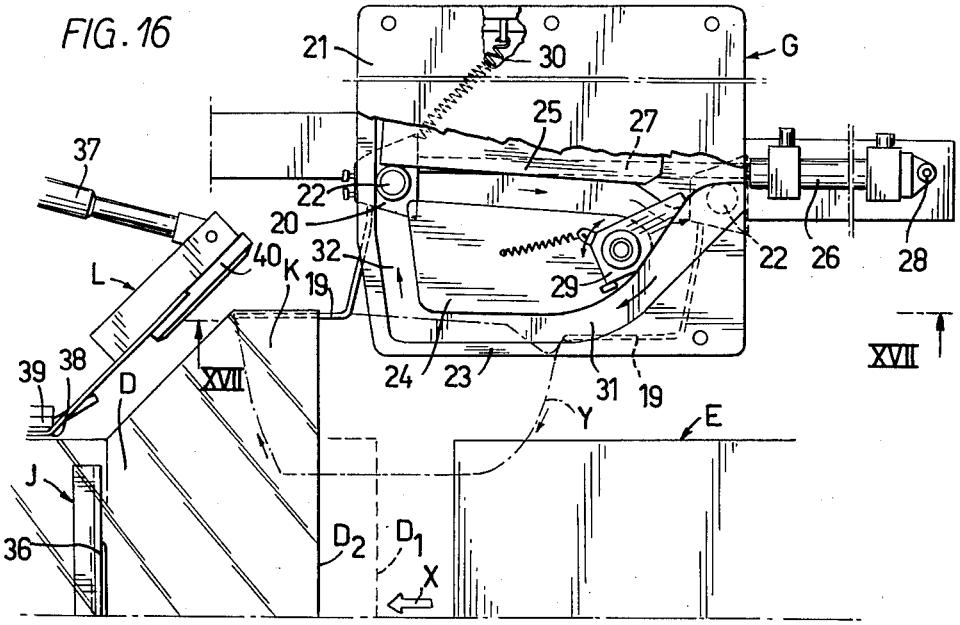
FIG. 13
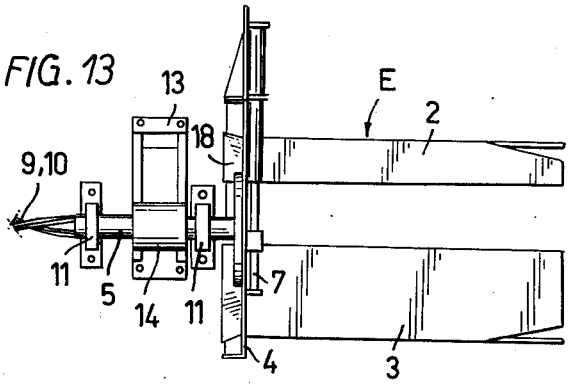
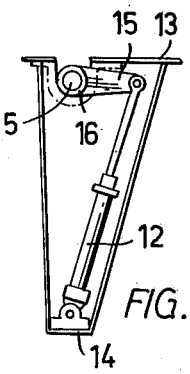
FIG. 15
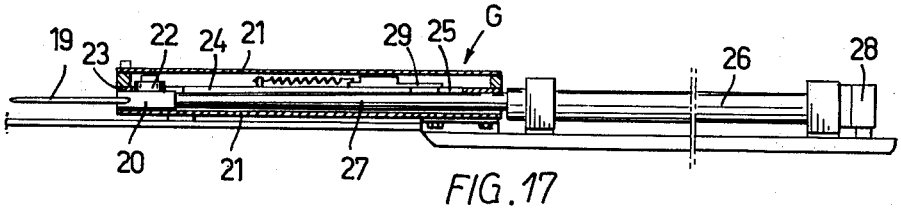
FIG. 17

MACHINE FOR FILLING A SACK WITH PIECE GOODS AND CLOSING MOUTH OPENING OF THE SACK

BACKGROUND OF THE INVENTION

The present application is a continuation-in-part of the parent application Ser. No. 466,885, filed May 3, 1974, now abandoned.

This invention relates to a machine for filling a sack of flexible material such as plastics with piece-goods and for closing the mouth opening of the sack to form a carrying handle, which machine comprises a sorting apparatus for stacking piece-goods into a desired filling shape and a closing apparatus for folding and seaming the mouth end of the sack.

This kind of machine is mainly intended for sacking of paper goods, such as paper rolls or small packages formed of these rolls, in larger amounts. However, this machine can also be applied equally well for sacking of many other single goods, such as boxes, cardboard packages and the like.

In order to facilitate handling of goods, for instance, paper rolls for domestic use are usually packed, for storage and transport to wholesale dealers and further to retail dealers, in amounts comprising several rolls into quite large plastic sacks. This kind of packing has hitherto been carried out by hand in factories, which demands a large number of hands and takes a long time.

Quite large-sized sacks used for this purpose have so far most often been closed by hand by means of plastic ribbons after the edging around the mouth opening of the sack has been folded together. These plastic ribbons can simultaneously function as carrying handles. In some cases, a welding seam has been welded across the mouth opening of the sack, which, however, makes further handling and transport of the filled sack quite difficult unless the sack is further provided with separate carrying handles.

The object of this invention is to provide a machine which enables to carry out the aforesaid filling- and closing operations mechanically and in which the mouth opening of the sack is closed in such a manner that the very edging of the mouth opening of the sack forms the required carrying handle.

BRIEF DESCRIPTION OF THE DRAWING

This invention is more closely described in the following with reference to the accompanying drawings which show a preferred embodiment of the machine according to the invention, whereby FIGS. 1–8 schematically show the different closing phases of the mouth opening of a sack, FIGS. 9–11 show a side, top and resp. end view of a packing machine, FIGS. 12, 13 and 14 show a from, side and resp. top view of a revolving apparatus with filling racks, FIG. 15 shows an end view of a swinging device of said revolving apparatus, FIGS. 16 and 17 show a top view of a spreading apparatus and resp. a cross-section of said apparatus along the line XVII—XVII in FIG. 16.

DESCRIPTION OF THE PREFERRED EMBODIMENTS

The packing machine shown in FIGS. 9–11 of the drawings comprises a sorting apparatus A for stacking the goods to be packed into a desired shape (a desired number of adjacent and successive rows and layers placed one upon another), a revolving apparatus B for moving sacks close to the packing machine and for filling the sacks with goods and a closing apparatus C for closing the mouth opening of the filled sack.

Figure 1:
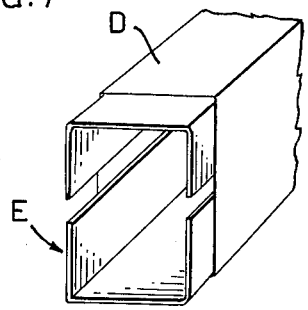
Figure 2:
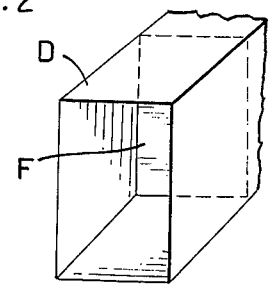
Figure 3:
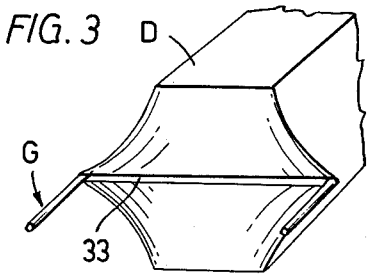
Figure 4:
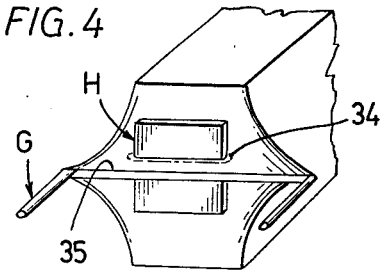
Figure 5:
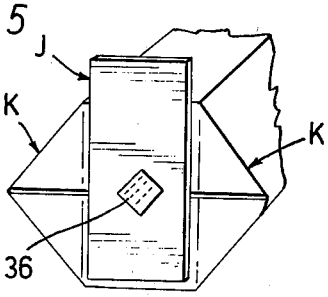
Figure 6:
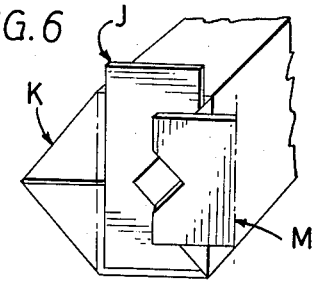
Figure 7:
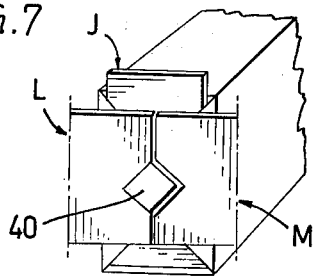
Figure 8:
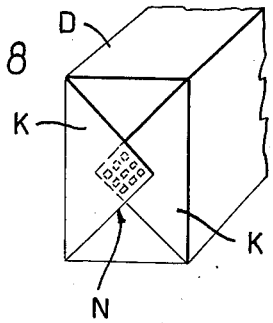

The different closing phases of the mouth opening of the filled sack are schematically shown in FIGS. 1–8. FIG. 1 shows a sack D while still out-stretched by a filling rack E, and FIG. 2 shows the sack after the goods F have been pushed into the sack and said sack with its goods has been pushed to the closing apparatus. FIG. 3 shows spreading of the mouth opening of the sack by a spreading device G in order to form a double edging, and FIG. 4 shows seaming of the double edging by means of welding jaws H. FIG. 5 shows how the end of the sack is pressed flat by a pushing plate J in order to form angle folds K. FIGS. 6 and 7 show folding of the angle folds one upon the other by means of folding- and welding plates L and M. FIG. 8 shows the ready end of the sack in which the angle folds seamed together form a carrying handle N.

As appears from FIGS. 9–11, the revolving apparatus B is arranged between the sorting apparatus A and the closing apparatus C. The revolving apparatus is more closely described in FIGS. 12–15, and it comprises at least two filling racks E, each of the racks including at least two jaws 2 and 3. Both the racks are fastened to a stand plate 4 in such a manner that the jaw 3 is fixed with respect to said plate but the jaw 2 is displaceable toward and from the jaw 3. In order to bring the racks alternately to a ready-for-operation and to a sacking position, the plate 4 with its racks E is rotatable to and fro through 180° in support of a shaft 5 positioned centrally on said plate. In FIG. 12 the right-hand rack is in the sacking and the left-hand one, in the ready-for-operation position.

The jaw 2, displaceable in both the racks with respect to the fixed jaw 3, is connected, at its end adjacent to the plate 4, to a frame 6 comprising branches 6′ and 6″ which are directed toward the jaw 3 and are guided by bars 7 fastened on said plate 4. The very frame is connected, at its centre, to the piston rod of a double-acting piston device 8 which thus moves the frame 6 and the jaw 2 alternately upward and downward. Pressure medium for the piston device 8 is brought by pipes 9 and 10 which are led through the rotation centre of the plate 4 and the shaft 5 and connected to a suitable pressure medium source.

The shaft 5 is fastened with bearings 11 to a fixed vertical surface behind the plate 4, to which surface is also connected the frame 13 of the protective casing round the piston device 12 which turns the shaft 5 back and forth. As appears from FIG. 15, the cylinder end of the piston device 12 is pivotably mounted on a fixed plate 14 and the piston rod end, on a crank 15 which is in turn wedged by a busing 16 on the shaft 5. When the piston device 12 is actuated, the crank 15 and the shaft rotate through 180° whereby the plate 4 with its racks E turns to and fro and thus the racks are moved from a ready-for-operation position to a sacking position and conversely.

When the rack E is in the ready-for-operation position, that is, on the left hand in FIG. 12, the piston device 8 has pushed the frame 6 and the jaw 2 toward the jaw 3, thus reducing the cross-section area limited by the jaws, whereby a plastic sack can easily be pulled by hand or mechanically upon the jaws 2, 3, so that the bottom of the sack is positioned as closely as possible against the free ends of the jaws and the edging of the sack mouth opening required for closing the plastic sack is folded against the plate 4. After this pulling phase, the piston device 8 pulls the jaw 2 back whereby the sack tightens round the jaws 2, 3. The left-hand jaw device turns to the right-hand position, and simultaneously the jaw device that was in the right-hand position turns to the ready-for-operation position and the piston device attached to said jaw device presses the jaw 2 toward the jaw 3. The operations of the jaws can be timed and carried out automatically but if pulling of an empty sack upon the jaws is performed by hand, the worker who does this can advantageously by suitable devices and at suitable moments actuate the piston device 12 resp. the piston device 8.

Into the plastic sack, which is in the sacking position, i.e., is out-stretched round the opened jaws 2, 3, is pushed by means of a plate-shaped pusher a certain amount of single packages stacked behind the plate 4 by the sorting apparatus A. This kind of pusher 16, which is only sketched in FIG. 14, moves toward the plate 4 pushing in front of it an amount of goods for one sack and then returns back in order to push the next goods amount into the following sack. The pusher 16 is most suitably made to move back and forth by means of the same kind of piston device as the piston device 8. The plate 4 is provided, right close to each pair of jaws, with an aperture 17 corresponding approximately to the opened mouth of the sack, compare FIG. 12. During pushing movement, the goods amount pushed by the pusher 16 is guided in side direction, and on the rear surface of the plate 4 is mounted a funnel-shaped collar 18 surrounding the aperture, so that the goods amount is brought to the right position inside the sack.

After sacking, the sack with its contents is removed from the pair of jaws and brought to the apparatus C for closing the mouth opening of the sack. For this removing operation, the shape and stroke length of the pusher 16 are made such that after filling the sack said pusher continues its stroke and pushes the sacked goods amount with its sack away from jaws 2, 3 to the closing apparatus. In this context, it should be noted that the cross-section of the jaws 2, 3 is preferably U-shaped, so that they together mould the cross-section of the sack pulled upon them into the shape of a square or rectangle, which enables effective use of sacks.

The afore-described apparatus can be rearranged with respect to its details in many different ways. Thus, there may be two or more racks E and they can be positioned on the rim of the revolving plate 4 at equal intervals around the rotation centre of said plate. Hereby, the plate is most suitably rotated continuously in the same direction, which presupposes that the pressure medium pipes 9, 10 are alternately connected, for instance by using suitable valve devices, to the pipe coming from a pressure medium source. It is also possible to construct the racks of more than two jaws whereby one or several of these jaws are made movable, so that the common cross-section area of the jaws can suitably be reduced when the rack is in a ready-for-operation position. If desired, all jaws can be made movable, which, however, makes the device more complicated. It is not either necessary to make the cross-section to jaws U-shaped but their shape is mainly determined according to the goods to be sacked and the plastic material used for sacks in order to ensure as undisturbed sack-filling as possible when the sack is stretched upon the rack.

FIG. 16 and 17 more closely describe an apparatus for spreading, folding and seaming of the mouth opening of the sack. Hereby, it is presupposed that the filled sack comes in a horizontal plane (in the plane of FIG. 16) in a rest position along the path of movement X from the apparatus A, stopping in the position shown in FIG. 16, so that the edge of the opened mouth of the sack D is approximately in the position D1. The pusher, which has filled the sack and pushed the filled sack to a closing position, is marked by the reference numeral 16 (FIG. 14).

The spreading device G comprises two spreading fingers 19 operating on both sides of the path of movement X. This finger is connected to a slide 20 moving between two horizontal plates 21. The slide is provided with a roll 22, the movement of which is guided by bars 23, 24, 25, carried by the supporting plates. The slide is connected to the piston rod 27 of a pressure cylinder 26. The pressure cylinder is mounted by an articulated pin 28 on the stand which also carries the supporting plates 21.

Between the supporting plates 21 there is also positioned pivotably a latch 29 which forces the slide to move always in the same direction around the guide bars 24 in the manner shown by the arrows. The spring 30 tends to pull the slide away from the path of movement X of the sack.

When the filled sack has moved to the position shown in FIG. 16, the spreading finger 19 is in the starting position shown by dash lines in FIG. 16. Hereby, the pressure cylinder receives an impulse to push the piston rod outwards whereby the roll of the slide first moves in the guide slot 31 until the roll reaches the slot 32 in which said roll moves rapidly, pulled by the spring 30, toward the guide bar 25. Thus the top of said spreading finger moves along the path Y shown with dash-and-dot line in FIG. 16, so that the finger is pushed inside the edge D1 of the sack mouth opening when the slide is moving in the slot 31, and said finger spreads the edge to the position D2 when the slide is moving in the slot 32.

After the mouth opening of the sack has been seamed in the manner described later, the cylinder 26 receives an impulse to pull the piston rod inwards whereby the slide moves back to its starting position along the guide bar 25.

When the spreading fingers 19 have been pushed to their terminal positions shown with unbroken lines in FIG. 16, the mouth opening of the sack forms a longitudinal narrow opening 33 (FIG. 3), which is mainly located in the plane of the drawing. In this position the mouth opening is ready for welding.

Proper welding may be preceded by prewelding, that is, a transverse preseam is made for welding together the edgings of the mouth opening, so that such a seam 34 (FIG. 4) is obtained which mainly runs in the plane of the drawing. The thus formed double edging 35 (FIG. 4) extends approximately over the filling breadth of the sack, so that the angle folds K stretched by the fingers 19 are not welded. This transverse seam can be welded by means of conventional welding jaws H (FIG. 4), which are pushed toward each other perpendicularly with respect to the plane of FIG. 16 but which are not shown in FIG. 16.

When this possible preseam 34 is ready, the angle folds K of the sack mouth opening are welded together. In order to make it possible that the double edging 35 of the mouth opening settles smoothly against the filled sack and that the angle folds maintain their triangular shape as well as possible during folding, there is provided a plate J which can be pushed against the mouth opening of the sack and which simultaneously forms a first welding surface 36 of the proper welding device. The welding device further comprises two swing flaps L, M (FIGS. 6, 7), one flap on both sides of the sack. Only one L of said flaps is shown in FIG. 16. These swing flaps are under influence of piston devices 37 positioned on both sides and corrected by flexible hinges 38 to the body plate 39 which supports the filled sack sidewardly. On one swing flap, i.e. the flap L, is positioned a second welding surface 40, whereas the other swing flap M, FIG. 6, (which is not shown in FIG. 16) is most suitably a thin plate which is provided with an incision or aperture through which the welding surface 40 of the swing flap L passes and settles against the welding surface 36 of the plate J. The operations of said swing flaps by means of their corresponding piston devices are timed so that the flap not shown in the drawing swings first against the plate J and then the flap L turns against said plate. The welding surfaces 36 and 40 may be dotted-like or of another shape so that the welding points form a dotted-, line-, or lattice-like welding area.

Before the swing flaps L, M can turn to a welding position, the fingers 19 must be detached from the angle folds K. During this detachment, the slide 20 moves along the guide bar 25 as described above. It is noted that the spreading finger moves from its starting position to a spreading position inside the path of movement X of the sack mouth and back to its starting position, outside said path of movement of the sack mouth, so that said finger does not disturb pushing of the next sack from the jaws 2, 3 to the closing apparatus. The top of the spreading finger is thus guided by the bars 23, 24, 25 to move along a closed loop path Y.

When the mouth opening of the sack has been closed in the aforedescribed manner, the next filled sack is ready to be pushed by means of the pusher 16 from the filling rack E to the closing apparatus C, whereby the new sack simulataneously pushes the ready sack away from said closing apparatus.

Figure 18:
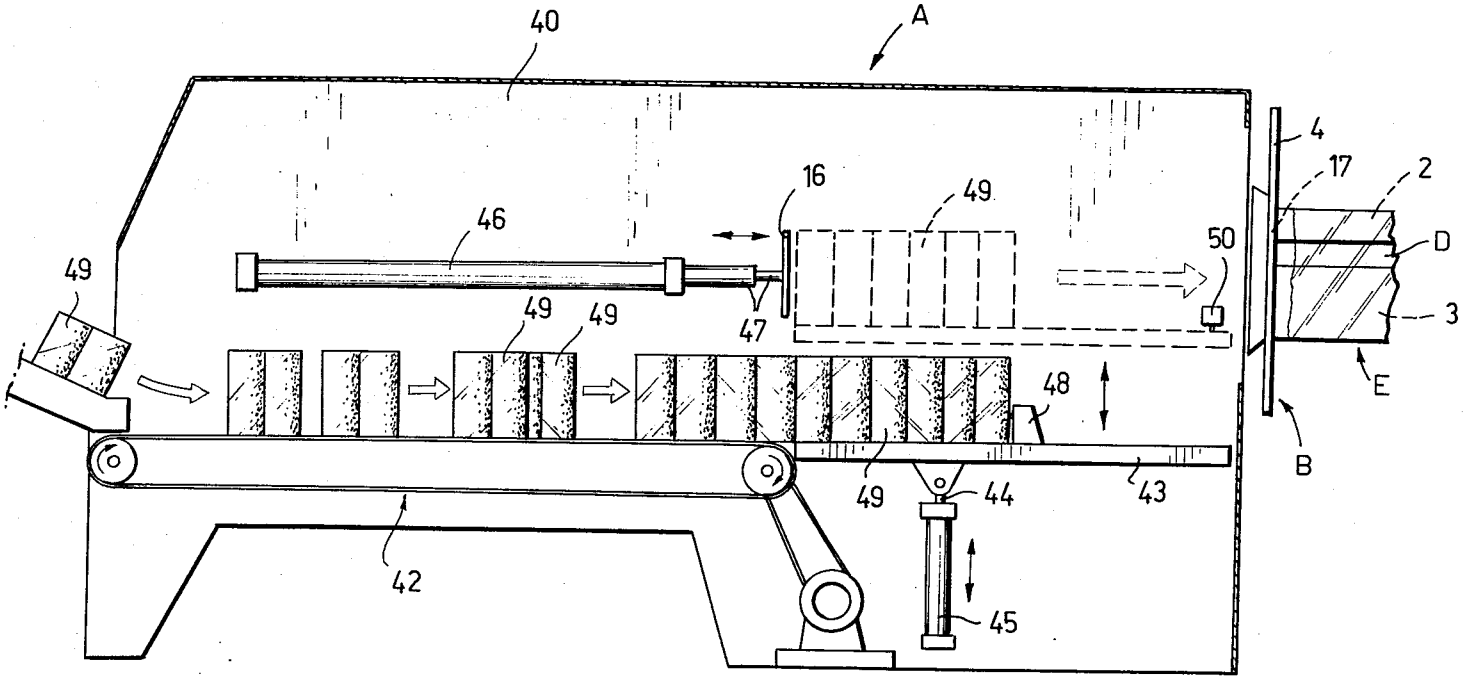
FIG. 18 is a vertical cross-section of a sorting apparatus of the packaging machine.

FIG. 18 illustrates schematically one embodiment of a sorting apparatus. The sorting apparatus A comprises vertical side plates 41 supporting a horizontal endless belt conveyor 42 as well as a vertically displaceable table 43 positioned at the outlet end of the conveyor 42. The table 43 is fastened to the piston rod 44 of a pneumatic cylinder 45 supported by said side plates. The table is displaceable vertically between a lower loading position indicated in FIG. 18 with full lines and an upper unloading position indicated in FIG. 18 with dotted lines. The side plates 41 further support a horizontally extending pneumatic multiple cylinder 46. The piston rod 47 of said cylinder is fastened to the pusher 16 mentioned above in connection with FIG. 14. In its inoperative position, the piston rod and the pusher are positioned as indicated with full lines in FIG. 18 and in their utmost operating position, the pusher is positioned approximately vertically in level with the pushing plate J of the closing apparatus C. The table further supports an adjustable limit switch 48.

The vertical plate 4 of the revolving apparatus B is positioned close to the outlet end of the sorting apparatus A perpendicularly to the direction of the cylinder 46 in such a way that the lower edge of each aperture 17 in said plate is in level with the surface of the table 43 in its upper unloading position in the sacking position of each rack E.

The sorting apparatus A operates in the following way:

Pre-wrapped packages 49 each comprising two towel rolls are supplied on the belt conveyor 42 in two parallel lines and the belt conveyor transports the packages forward upon the table 43. When the front packages contact the limit switch 48 an impulse first stops the belt conveyor 42 and thereafter actuates the cylinder 45 for lifting the table 43 and the packages supported thereby to the upper position of the table. In the upper position the table actuates a second limit switch 50 which causes an impulse for actuating the cylinder 46. Due to this the piston rod is moved to its outer position so that the pusher 16 pushes the packages supported by the table out through the aperture 17, between the jaws 2, 3 associated with said aperture and consequently also into the sack D carried by said jaws. The pusher 16 further pushes the sacked packages including the sack into the closing apparatus C. After the piston rod 47 has carried out its stroke a further limit switch not shown causes an impulse which retracts the pusher 16, lowers the table 43, and finally starts the conveyor for sorting the following set of packages on the table.

Figure 19:
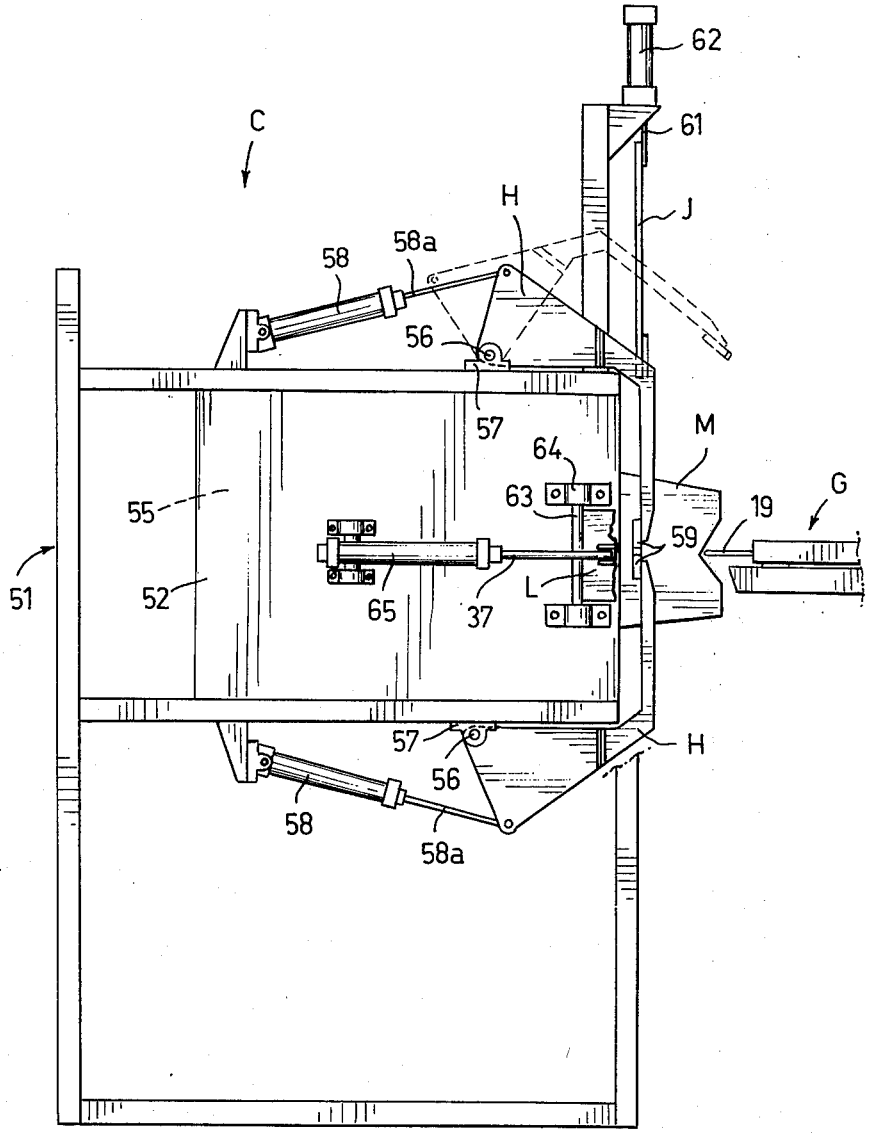
FIG. 19 is a schematic vertical side view of the closing and welding mechanism of the closing apparatus in an enlarged scale.
Figure 20:
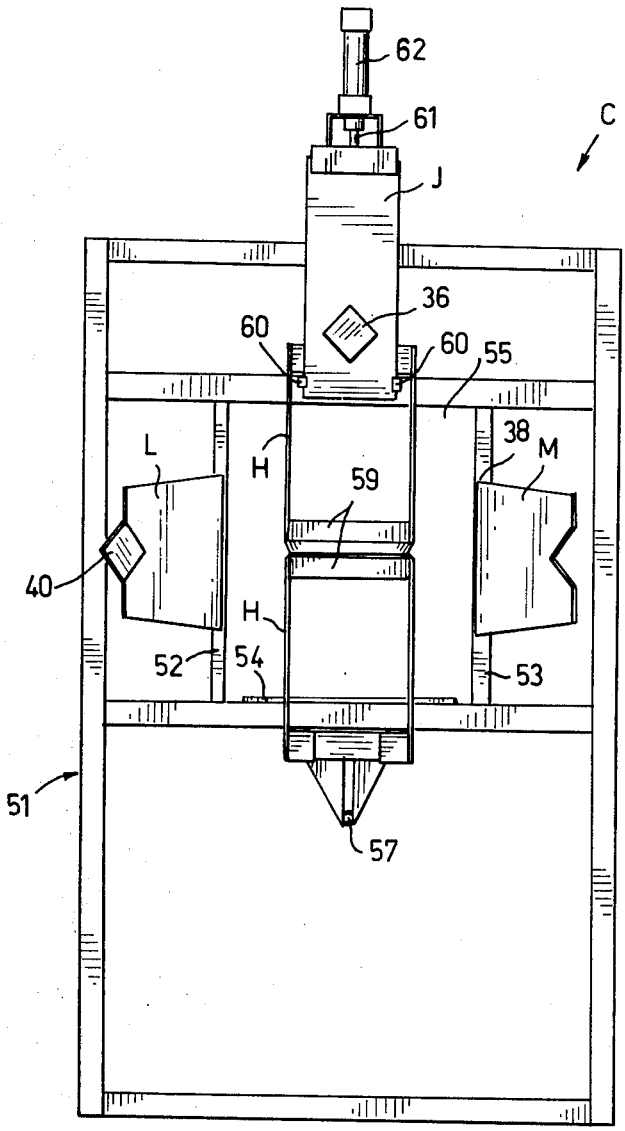
FIG. 20 is a schematic front view of the apparatus according to FIG. 19.

The closing and seaming apparatus C illustrated in FIGS. 19 and 20 comprises a frame construction 51 supporting two mutually spaced vertical side plates 52, 53 and a horizontal bottom plate 54 which form a horizontal channel 55 into which the sack D filled with packages 49 is pushed by means of the pusher 16 from the sorting apparatus.

The closing and seaming apparatus comprises two welding jaws H mounted above and below channel 55. The welding jaws are each fastened to a horizontal shaft 56 pivotably mounted in bearings 57 supported by the frame 51 and are pivotably fastened also to the piston rod 58*a* of a pneumatic cylinder 58 also supported by the frame. The welding jaws are provided with welding plates 59 provided at the free end of each jaw. The welding jaws are pivotable between a welding position illustrated in full lines in FIGS. 19 and 20 for welding of the preseam 34 mentioned in connection with FIG. 4 and an inoperative position shown by dotted lines in FIG. 19.

The closing and seaming apparatus C further comprises a pushing plate J which is vertically slidably mounted in guides 60 supported by the frame and is fastened to the piston rod 61 of a pneumatic cylinder 62 supported by the frame. The pushing plate J is displaceable between an upper position illustrated by full lines in FIGS. 19 and 20 and a lower position illustrated in FIG. 5 for flat pressing of the preseamed sack end. The pushing plate is further provided with the first welding surface 36 mentioned above in connection with FIG. 5.

The closing and seaming apparatus C also comprises two swing flaps L and M, one flap on each side of said channel 55. Each flap is fastened to a vertical shaft 63 pivotably mounted in bearings 64 supported by the side plates 52 and 53 respectively and is pivotably fastened also to the piston rod 37 of a pneumatic cylinder 65 supported by the side plates 52 and 53 respectively. The swing flap L is provided with the second welding surface 40 of the welding device. The swing flaps L, M are pivotable between an inoperative position shown by full lines in FIGS. 19 and 20 and the welding position illustrated in FIG. 7 for folding of the angle folds K of the sack and seaming of said folds to each other.

The successive operation of the means H, J, L and M has been described in connection with the FIGS. 4 – 8. The pneumatic cylinders are actuated in sequence e.g. by normal limit switches and time relays. The preseaming-, folding- and welding operation is started when a filled sack is pushed into the channel 55 and contacts a starting switch, not shown.

The drawing and the accompanying description is intended only to illustrate the principle of the invention. Regarding details, the machine according to the invention may vary considerably within the scope of the following claims.

We claim:

1. A machine for filing a sack of flexible material such as plastics and for closing the mouth opening of the sack to form a carrying handle comprising sorting means for stacking piece-goods into a predetermined shape; closing means for folding and seaming the mouth opening of said sack when filled, said sorting means and said closing means being arranged after each other for operating in predetermined sequence, revolving means between said sorting means and closing means and having filling racks and being displaceable in a transverse plane with respect to said line between a ready-for-operation position, in which said filing rack is positioned outside said line to receive an empty sack, and a sacking position, in which said filling rack is positioned on said line to push goods into the sack and to push the filled sack to said closing means; said closing means comprising two spreading devices positioned on different sides of the mouth opening of the sack, said devices having fingers adapted to grip the mouth opening of the sack and to stretch said mouth opening to form a narrow opening, so that the free side walls of said sack mouth opening are at least positioned substantially opposite each other to form a double edging, a supporting plate to be positioned against the mouth opening of the sack to turn said double edging to a closing plane, two swing flaps positioned close to said spreading devices to turn angle folds formed by said fingers upon said supporting plate, and welding means for welding together said folded angle folds.

2. A machine according to claim 1, wherein said welding means is attached to one swing flap, said welding means being mounted to extend through said swing flaps and to co-operate with a welding surface positioned on said supporting plate to form a weld connecting the ends of both angle folds.

3. A machine according to claim 1, wherein said welding means is mounted on opposite sides of the mouth opening of the sack and between spreading devices for welding together the double edging formed by said fingers substantially along a line running in the sack-closing plane before said angle folds are attached to each other.

4. A machine according to claim 1, including piston means connected to each of said fingers for actuating the same, slide and guide bars connected to each finger so that the top of the finger moves along a closed loop line, whereby the movement of said top to the spreading position occurs inside the path of movement of the sack mouth to be spread out, the movement away from the spreading position taking place outside said path of movement of the sack mouth.

* * * * *